US005289884A

United States Patent [19]

Johnstone

[11] Patent Number: 5,289,884

[45] Date of Patent: Mar. 1, 1994

[54] WELL PUMPING

[75] Inventor: James E. Johnstone, Huntington Beach, Calif.

[73] Assignee: Atlantic Richfield Company, Los Angeles, Calif.

[21] Appl. No.: 34,957

[22] Filed: Mar. 22, 1993

[51] Int. Cl.[5] ..... E21B 33/03

[52] U.S. Cl. ..... 166/387; 166/84

[58] Field of Search ..... 166/369, 372, 387, 84, 166/86

[56] References Cited

U.S. PATENT DOCUMENTS

| | | | |
|---|---|---|---|
| 4,889,184 | 12/1989 | Lugtmeier et al. | 166/84 X |
| 5,058,668 | 10/1991 | Newton | 166/84 X |
| 5,088,559 | 2/1992 | Taliaferro | 166/387 X |
| 5,141,052 | 8/1992 | Bump | 166/84 X |

*Primary Examiner*—Thuy M. Bui

*Attorney, Agent, or Firm*—R. W. MacDonald

[57] ABSTRACT

Method and apparatus for sucker rod pumping in a wellbore using, in lieu of a stuffing box, first and second seal members connected by a length of compressible hose, the first seal member adapted to seal with the wellhead in a liquid and vapor tight manner and the second seal member adapted to seal with the sucker rod string in a liquid and vapor tight manner.

9 Claims, 2 Drawing Sheets

WELL PUMPING

BACKGROUND OF THE INVENTION

When a well such as an oil and gas well produces a liquid product such as crude oil which is desirably recovered at the earth's surface but the well does not have sufficient natural pressure in the reservoir to force the liquid product to the earth's surface, artificial pumping, sometimes referred to as artificial lifting, is employed. Artificial pumping forces the desired liquid product through the wellbore to the earth's surface for recovery and other utilization as desired.

One of the more common forms of artificial pumping used, particularly in the oil patch, is sucker rod pumping wherein a sucker rod string is employed in the wellbore and carries at the bottom end thereof a positive displacement pump. By reciprocating the sucker rod string and pump up and down inside the well tubing, work is transferred to the downhole positive displacement pump with the result that liquid product in the well tubing is forced upwardly through the tubing to the earth's surface.

The sucker rod string is reciprocated through the use of a pumping unit located at the earth's surface. This requires the sucker rod string to be reciprocated continuously through an opening in the wellhead that caps the well at the earth's surface. The area of concern to which this invention is directed is the area where the sucker rod string enters the wellhead. A seal is universally employed in this area to prevent well fluids, both liquid and gaseous, from escaping from around the sucker rod string out of the wellhead and into the earth's atmosphere.

The type of sucker rod seal most used by the prior art employs packing elements that are mechanically forced against a highly smooth sucker rod section called a polish rod. The packing elements press against the polish rod to achieve good sealing around the polish rod and to prevent, to the maximum extent possible, leakage from the interior of the wellhead around the polish rod and then to the exterior of the wellhead. Because the polish rod moves repeatedly up and down through these packing elements over a long period of time, the elements are subject to mechanical wear so that the stuffing box requires continual monitoring to adjust or replace worn packing elements to insure leakage prevention.

This type of stuffing box and its packing elements rely on the presence of some liquid lubricant between the polish rod and the packing elements which can sometimes escape outside the wellhead. Further, this equipment is not designed to form a reliable gas-tight seal around the polish rod so that the escape of volatile organic compounds from inside the wellhead and around the polish rod is also possible. As requirements tighten on the tolerable amount of liquid and gas allowed to escape around the polish rod, operator monitoring of each stuffing box necessarily increases, sometimes even to daily checks, to insure compliance with the volatile organic compound emission limits.

SUMMARY OF THE INVENTION

In accordance with this invention, there is provided a method and apparatus which replaces the conventional stuffing box sealing approach described hereinabove with a sucker rod sealing technique that can be employed in conventional wellheads but which yields a seal in the vicinity of the old stuffing box which reliably contains all liquids and gases present in the interior of the wellhead. Accordingly, this invention will meet volatile organic compound limits while eliminating the regular monitoring requirements of the conventional stuffing box. It can be seen, therefore, that the apparatus of this invention eliminates the need for the conventional stuffing box and polish rod without eliminating the functions thereof.

More specifically, this invention provides a method for sucker rod style pumping which does not require a polish rod but which otherwise employs a conventional sucker rod string wherein a first seal is fixed to the wellhead, the first seal carrying a length of longitudinally compressible hose therebelow, which hose is terminated by a second seal that is fixed in a vapor tight manner to the sucker rod. The sucker rod string is then reciprocated in normal pumping fashion while expanding and contracting the compressible hose, thereby producing well fluids from the interior of the well up to the earth's surface.

This invention relates to a seal assembly for use in the manner described hereinabove which employs first and second seals connected by a length of compressible hose, the first seal being adapted to seal with the wellhead in a vapor tight manner and the second seal being adapted to fit around the sucker rod string in a vapor tight manner.

Accordingly, it is an object of this invention to provide a new and improved sealing method and apparatus for use in sucker rod pumping of wells, particularly oil wells. It is another object to provide a new and improved method for artificially lifting wells using a sucker rod technique wherein the wellhead is reliably maintained in a vapor tight condition. It is another object to eliminate the conventional stuffing box and polish rod without eliminating the functions thereof. It is another object to provide a new and improved method and apparatus wherein sucker rod pumping can be carried on with drastically reduced requirements for monitoring the equipment during use for liquid or vapor leakage. Other aspects, objects and advantages of this invention will be apparent to those skilled in the art from the disclosure and the appended claims.

DETAILED DESCRIPTION

Figure 1:
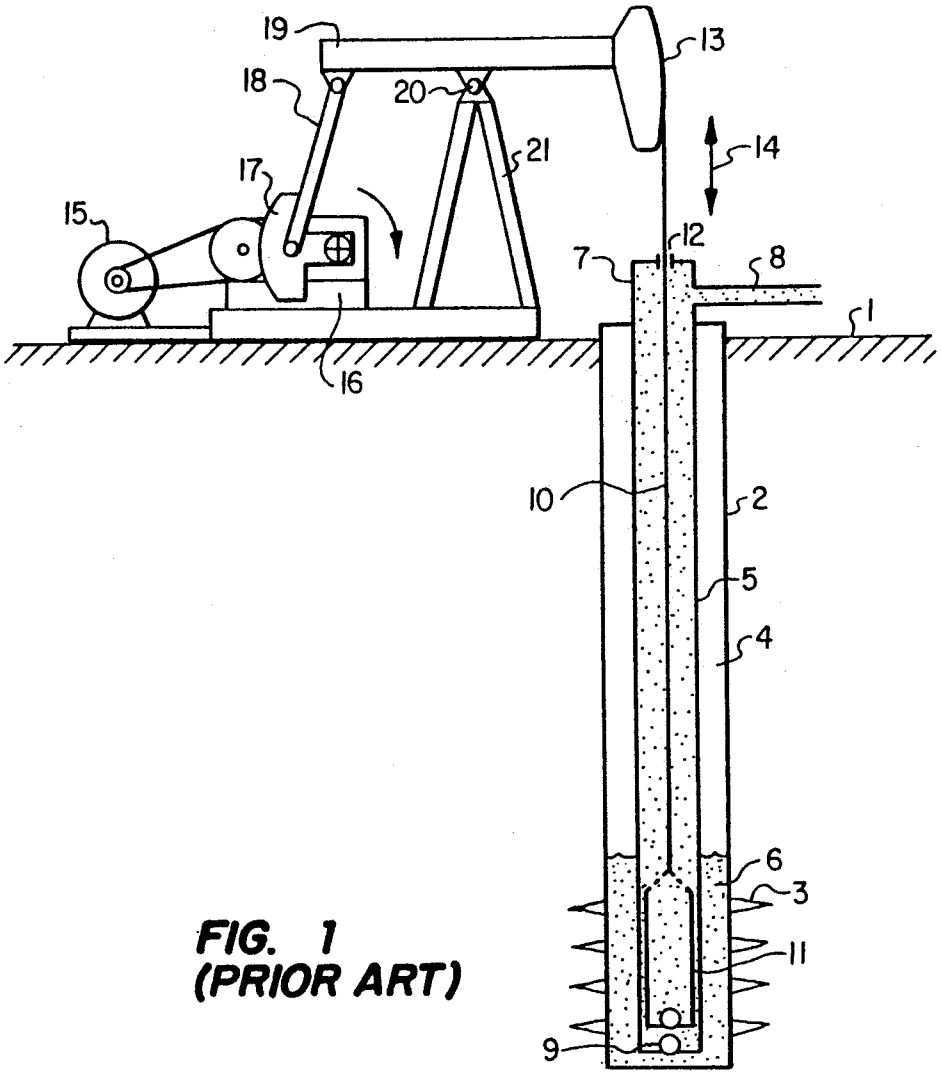
FIG. 1 (PRIOR ART)
FIG. 1 shows a cross section of a conventional wellbore using sucker rod pumping equipment with a polish rod and downhole pump together with a surface pumping unit.

FIG. 1 shows the earth's surface 1 into which has been drilled a wellbore 2, wellbore 2 being lined by conventional steel pipe known as casing (not shown).

Perforations 3 through the casing into the earth surrounding wellbore 2 allows liquid and gas contained in the earth to flow into the interior 4 of the wellbore. A string of pipe 5 known as production tubing extends from earth surface 1 down into wellbore 2 to the vicinity of perforations 3 and into the liquid 6 that has been produced into the wellbore through perforations 3. Liquid 6 remains at the bottom of the wellbore because there is insufficient pressure behind the fluids in the earth surrounding perforations 3 to force produced liquid 6 upwardly in the interior of tubing 5 to wellhead 7 for recovery and other disposition as desired by way of pipe 8.

Tubing has an aperture at the bottom thereof which is fit with a check valve 9 to allow liquid 6 to flow into the interior of tubing 5 but not back out of tubing 5. Sucker rod string 10 hangs in the interior of production tubing 5 and carries downhole pump 11 at its lower end. Sucker rod string 10 is connected at its upper end, after it leaves wellhead 7 at aperture 12, to horse head 13.

Horse head 13 is reciprocated up and down in the manner shown by arrows 14 by operation of prime mover 15 which is operably connected through gear reducer 16 to crank and counter-weight 17. Crank 17, by means of pitman 18, raises and lowers the end of walking beam 19 which is opposite from horse head 13, walking beam 19 being pivoted at the top 20 of sampson post 21.

The stuffing box is employed in the vicinity of o aperture 12 of wellhead 7 to prevent gas and liquid within wellhead 7 from escaping through aperture 12 to the earth's atmosphere.

Figure 2:
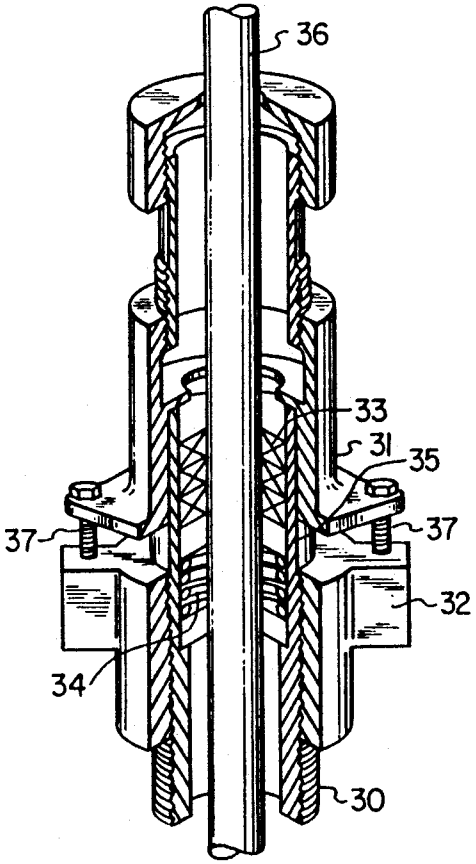
FIG. 2 (PRIOR ART)
FIG. 2 shows a cross section of a conventional single-packed stuffing box which would be employed at the top of the wellhead in FIG. 1 where the sucker rod string exits the wellhead.

FIG. 2 shows a conventional stuffing box which is often used in aperture 12. The stuffing box is composed of support member 30 which is fixed to wellhead 7 and which carries adjustable packing support members 31 and 32. Members 31 and 32 carry internally thereof packing elements 33 and a coil spring 34 within glands 35. The polish rod portion 36 of sucker rod string 10 passes through the stuffing box in physical contact with packing 33 to provide the desired seal to prevent liquid and gases from escaping from the interior of wellhead 7 to the earth's atmosphere. Leakage of liquid and/or gas around polish rod 36 and past packing 33 is prevented by tightening screw means 37 to force member 31 toward member 32 thereby compressing packing 33 against coil spring 34 and forcing packing 33 tightly against polish rod 36. However, with repeated reciprocation of polish rod 36 in contact with packing 33, physical wear of packing 33 is unavoidable. This can lead to the requirement of regular monitoring of this apparatus for leakage and regular tightening of screw means 37 as required.

Figure 3:
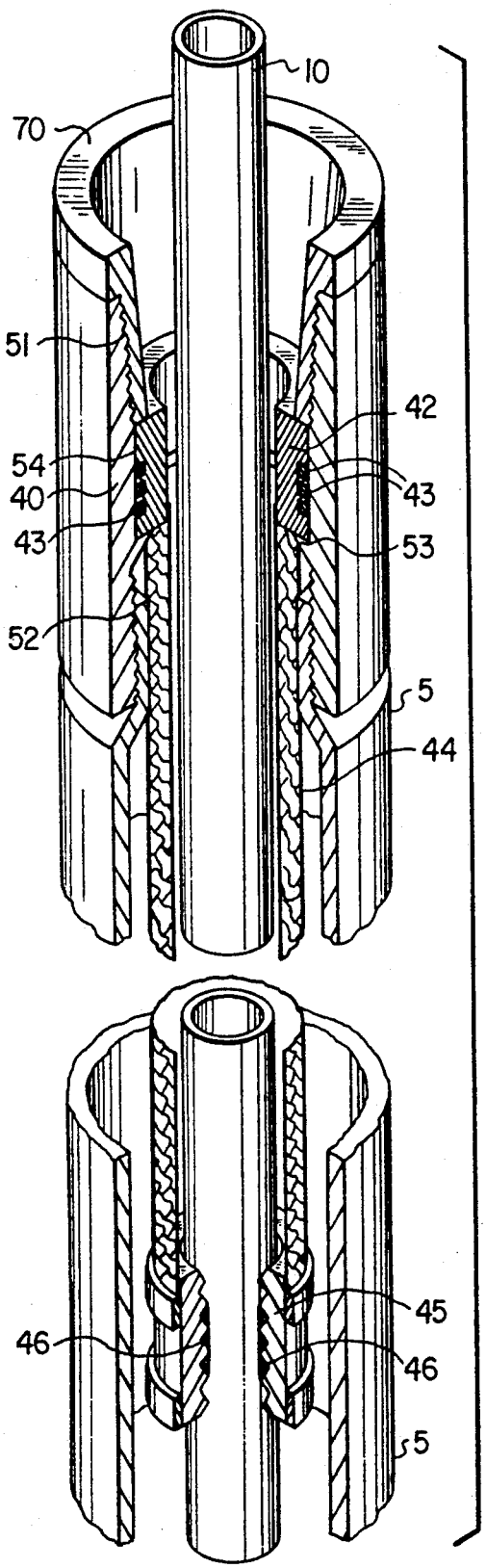
FIG. 3 shows a cross section of well tubing together with one embodiment of the apparatus of this invention installed therein and a sucker rod string extending therethrough.

The apparatus shown in FIG. 3 is one embodiment of apparatus that can be employed pursuant to the inventive concept of this invention in lieu of the conventional stuffing box of FIG. 2 in aperture 12 of wellhead 7.

The apparatus of this invention is disposed inside o production tubing 5 and is composed of a landing collar 40 designed to mate at one end with the upper end of tubing 5 and to receive a first seal 42. Seal 42 has seal elements 43 on the outer surface thereof for sealing with the inner surface of collar 40 in a liquid and vapor tight manner.

First seal 42 carries a length of compressible hose 44 which extends downwardly into tubing 5 a finite length which length can vary substantially depending upon the particular equipment used. The lower end of compressible hose 44 is terminated by a second seal 45 which carries internal sealing elements 46 which seal around the external surface of sucker rod string 10 in a liquid and vapor tight manner. In this invention, conventional (unpolished) sucker rod is employed at this location in lieu of polish rod 36 of FIG. 2.

Accordingly, it can be seen that the reciprocal pumping movement of sucker rod 10 no longer relies upon a sealing mechanism that involves the sucker rod sealing against a packing element with which the sucker rod is in constant physical contact. Rather, the sealing effected by this invention is fixed and not subject to the same type of wear and tear as the stuffing box of FIG. 2. This new technique for sealing relies upon more reliable static as opposed to dynamic sealing at the sucker rod itself and yields a much more gas tight seal and a much more reliable seal over extended periods of use than the apparatus of FIG. 2. The dynamic seal effect of this invention is not concentrated over a small area of packing 33 as shown in FIG. 2 but rather is distributed over a much longer length of sealing medium (hose element) 44 thereby distributing the wear and tear over a much larger area of moving material. Further, with the improvement in rubber hose, rubber hose composites, braided metal hose, and the like, compressible hose element 44 can be made to be highly durable as well as vapor tight, whether extended or compressed, so that a much stronger and larger member can be employed by this invention to absorb the work of dynamic sealing that was heretofore imposed on a small quantity of packing 33.

Compressible hose 44 compresses linearly and, although it displaces somewhat laterally, does not displace laterally to any substantial degree so that the energy absorption by compressible member 44 is taken up largely in the longitudinal direction. This way wear of this element by impacting the internal surface of tubing 5 is not a significant risk and can be adapted for by the physical design of flexible member 44 at the outset. The types of compressible hoses contemplated by this invention are commercially available and well known to those skilled in the art so that further description of that element is unnecessary to inform the art.

Figure 5:
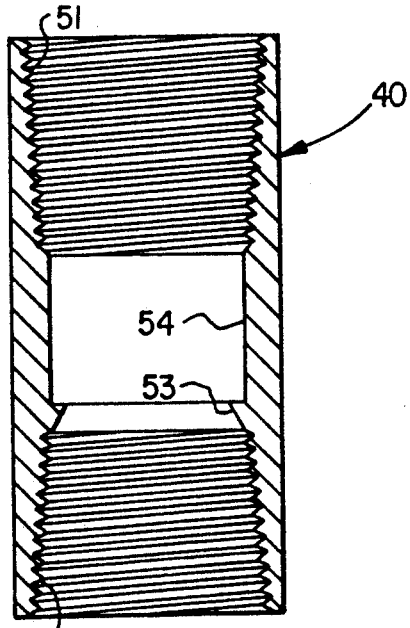
FIG. 5 shows one embodiment of a landing collar that could be employed with the seal assembly of FIG. 4 in the embodiment shown in FIG. 3.

FIG. 5 shows landing collar 40 to be a hollow right cylindrical member of circular cross sectional configuration which is threaded at both ends. Collar 40 is threaded internally in the case of FIG. 5, although external threading could also be employed. Accordingly, landing collar 40 can be joined at both ends by other pipe members. Between threaded sections 51 and 52 a stop means 53 is employed for receiving and holding first seal 42. Collar 40 carries above stop means 53 an upstanding smooth surface 54 which surface is designed to sealingly engage seal elements 43 of first seal 42 as is shown in FIG. 3.

Figure 4:
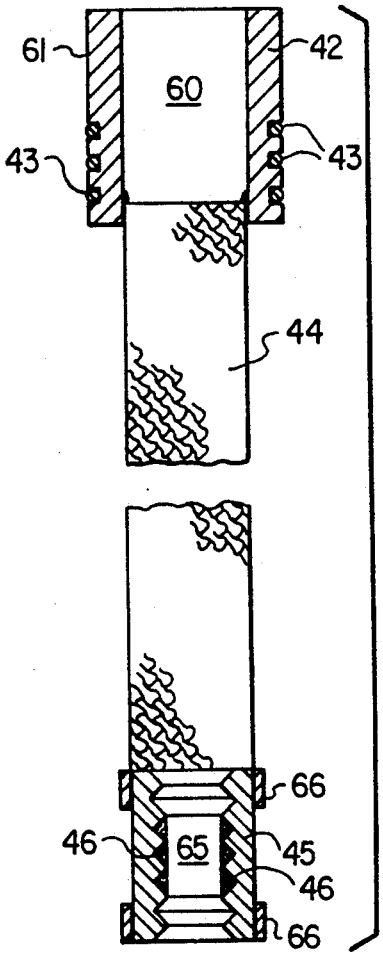
FIG. 4 shows the seal assembly of FIG. 3 by itself.

FIG. 4 shows first seal 42 also to be of right cylindrical configuration with a circular cross section and an aperture 60 therethrough for passage of sucker rod 10. Seal 42 has on its outer surface three seal elements 43 such as rubber O-rings or the like. The outer diameter of seal element 42 plus the extent of protrusion of seal elements 43 beyond the outer surface 61 of first seal 42 is sized so that the protruding portions of seal elements 43 fit snugly against surface 54 of landing collar 40 thereby to provide a liquid and vapor tight sealing engagement between the wellhead and the seal assembly of FIG. 4.

Second seal 54 carries on its internal surface surrounding aperture 65 (through which passes sucker rod 10 as it passes through aperture 60 and the interior of compressible hose 44) a plurality of internal second seal elements 46 which are designed to bear against the outer surface of sucker rod 10 in a liquid and vapor tight sealing manner and to be physically held in that sealing position by means of conventional annular clamps 66. Clamps 66 can be any annular clamp means known in the art for squeezing a flexible annular member around the periphery of an enclosed circular member such as sucker rod 10.

In operation, the seal assembly of FIG. 4 is slid over the sucker rod string and made up to the last stand of sucker rods in that string by tightening clamps 66 until the desired sealing engagement between seal element 45 and sucker rod string 10 is achieved. Landing collar 40 is then threadably engaged with the exposed threads that normally extend above the tubing 5 hanger. In other words, threads 52 of collar 40 are made to engage the upper end of tubing 5 as shown in FIG. 3. The last stand of sucker rod 10 is then made up to the sucker rod string already hanging in the well. The sucker rod string together with the seal assembly of FIG. 4 is then lowered into the interior of tubing 5 until first seal 42 lands in collar 40 on stop 53. A top hold down bushing 70 (FIG. 3) is then threadably engaged with threads 51 of collar 40 to prevent upward movement of seal 42. The well is then hung off in the well in a conventional manner well known to those skilled in the art.

Reasonable variations and modifications are possible within the scope of this disclosure without departing from the spirit and scope of this invention.

What is claimed is:

1. In a well pumping method in which a sucker rod string is reciprocated from the earth's surface inside a pipe string that has an inner surface and extends downwardly into a wellbore, the improvement comprising providing an upper seal which surrounds said sucker rod string and seals against said inner surface in a vapor tight manner, said upper seal carrying a length of longitudinally compressible hose therebelow, said compressible hose carrying a lower seal that is fixed to said sucker rod string in a vapor tight manner, and reciprocating said sucker rod string while expanding and contracting said compressible hose within said pipe string, to produce well fluids from the interior of said pipe string to the earth's surface below said upper seal.

2. A seal assembly for use in a sucker rod well pumping system which employs a hollow pipe string that extends downwardly into a well comprising a first seal carrying at least one first sealing element, said first seal being of a configuration such that said sucker rod can reciprocate through said first seal while said at least one sealing element engages the inner surface of said hollow pipe string in a vapor tight sealing manner, said first seal carrying a length of longitudinally compressible hose, and said hose carrying a second seal carrying at least one second sealing element, said second seal being of a configuration to fit around said sucker rod so that said at least one second sealing element engages said sucker rod in a vapor tight manner.

3. Apparatus according to claim 2 wherein said first and second seals and said compressible hose are essentially circular in cross section.

4. Apparatus according to claim 2 wherein said compressible hose is a woven metal hose.

5. Apparatus according to claim 2 wherein said compressible hose is rubber hose.

6. Apparatus according to claim 2 including a hollow landing collar which is threaded at both ends for receiving other pipe members, said collar carrying internally thereof a stop for receiving and holding said first seal, and said collar carrying above said stop an upstanding surface for sealingly engaging said at least one first seal element of said first seal.

7. In apparatus for pumping a well wherein a sucker rod string is reciprocated inside a pipe string that has an inner surface and extends downwardly into a wellbore, the improvement comprising a seal assembly carried by and internally of said pipe string, said seal assembly comprising a first seal carried by said pipe string, said first seal having at least one first sealing elements for sealing against said inner surface of said pipe string, said first seal having an aperture through which said sucker rod string can be reciprocated, said first seal carrying a compressible hose through which said sucker rod string can extend, said compressible hose carrying a second seal having an aperture through which said sucker rod string can extend and at least one second sealing element for sealing against said sucker rod string, said second seal also carrying a fastener for fixing said second seal to said sucker rod string.

8. Apparatus according to claim 7 wherein said first and second seals are essentially annular in shape.

9. Apparatus according to claim 7 wherein said first sealing elements are carried on the outer surface of said first seal, and said second sealing elements are carried on the inner surface of said second seal.

* * * * *